US005942473A

United States Patent [19]

Knerr et al.

[11] Patent Number: 5,942,473

[45] Date of Patent: Aug. 24, 1999

[54] SOLID MAGNET WIRE WINDING LUBRICANTS

[75] Inventors: Allan R. Knerr; Michael W. Lindvay, both of Fort Wayne, Ind.

[73] Assignee: Phelps Dodge Industries, Inc., Fort Wayne, Ind.

[21] Appl. No.: 08/661,378

[22] Filed: Jun. 11, 1996

Related U.S. Application Data

[63] Continuation of application No. 08/290,482, Aug. 15, 1994, abandoned.

[51] Int. Cl.[6] ..... C10M 105/32; C10M 105/34; C10M 105/36

[52] U.S. Cl. ..... 508/465; 508/463; 508/501

[58] Field of Search ..... 508/501, 465, 508/463

[56] References Cited

U.S. PATENT DOCUMENTS

| | | | |
|---|---|---|---|
| 4,385,436 | 5/1983 | Saunders et al. | 29/596 |
| 4,385,437 | 5/1983 | Saunders et al. | 29/596 |
| 4,605,917 | 8/1986 | Ide et al. | 335/128 |

*Primary Examiner*—Jerry D. Johnson
*Attorney, Agent, or Firm*—Lundy and Associates

[57] ABSTRACT

A magnet wire insulation material having combined therewith a magnet wire winding lubricant having the formula of where n is from about 0 to about 26, m is from about 1 to about 35 and R is a hydrogen atom or any alkyl or acyl radical or a radical, and $R^1$ is a hydrogen atom or an alkyl or an acyl radical and a magnet wire having superimposed on a base insulation material a coating of a lubricant having the formula of where n is from about 0 to about 26, m is from about 0 to about 35 and R is a hydrogen atom or any alkyl or acyl radical or a radical, and $R^1$ is a hydrogen atom or an alkyl or an acyl radical.

11 Claims, 1 Drawing Sheet

SOLID MAGNET WIRE WINDING LUBRICANTS

This is a continuation of application Ser. No. 08/290,482 filed on Aug. 15, 1994 now abandoned.

BACKGROUND OF THE INVENTION

This application pertains to lubricants applied to magnet wire are utilized to facilitate the winding of magnet wire into coils and to allow magnet wire coils to be inserted into coil support slots without damage to the insulation. More particularly, this invention relates to an improved solid magnet wire winding lubricant which can be used both as an internal lubricant and an external lubricant and which is compatible with the new non-chlorinated refrigerants such as Du Pont's R134a FREON and their lubricants now expected to be used in hermetic systems throughout the world.

Magnet wire winding lubricants have been widely utilized in the past. Today, nearly all magnet wire utilized in coils is utilized with a magnet wire lubricant to ease the winding of magnet wire into coils. Magnet wire lubricants are used in the winding of both stator coils and rotor coils in the manufacture of electrical motors wherein a plurality of windings need to be stacked in metal coil support slots and considerable wire to wire and wire to slot frictional resistance is experienced. Magnet wire lubricants are used not only to reduce this friction, but to insure that the magnet wire coils can be wound and/or inserted into coil supports without damage to the insulation. Such magnet wire lubricants generally must be chemically inert so that the lubricant will not degrade the magnet wire insulation or change the composition of other materials within which it comes in contact, and be capable of being applied to magnet wire. In addition, those magnet wire winding lubricants used in hermetic systems must be soluble in and compatible with both the refrigerants and the compressor lubricants used in such systems.

Within the industry, there are now used both internal and external lubricants. Internal lubricants are those which are mixed as a component of the magnet wire enamel and applied to the wire as a superimposed enamel coating on the wire. Other lubricants are used as external lubricants and are applied as a superimposed coating over the base insulation of the magnet wire. In either case, the lubricant partially defines the exterior surface of the magnet wire such that it engages either other turns of the coil, or the structure of the coil support during winding of the coil. The purpose of the lubricant is to allow the coils to be wound and inserted into coil supports without undue stretching of the wire or damage to the insulation by conventional winding machines.

It is therefore highly desirable to provide new and improved solid magnet wire winding lubricants.

It is also highly desirable to provide new and improved solid magnet wire winding lubricants which can be utilized as internal lubricants.

It is also highly desirable to provide new and improved solid magnet wire winding lubricants which can be used as external lubricants.

Most of the lubricants now used are a paraffin, hydrogenated triglyceride and/or fatty ester based lubricant. These materials are not suitable nor compatible with the newly proposed chlorine free refrigerants, or their compressor oils throughout their operational range. With the change from chlorinated refrigerants, such as Du Pont's R-12 and R-22 to chlorine free refrigerants such as Du Pont's R134a, a change was made from mineral oil based compressor lubricants previously used with the chlorinated refrigerants to ester or ether based compressor lubricants. This change was mandated due to the fact that the chlorinated refrigerants were miscible with mineral oil, whereas the new chlorine free refrigerants are more polar and are not miscible with mineral oil and require a more polar lubricant.

While magnet wire winding lubricants based upon paraffins, hydrogenated triglycerides and fatty esters of fatty acids are compatible with mineral oils, the same are not compatible in the more polar compressor lubricants such as the EMKARATE and the MOBIL compressor lubricants which are thought to be an eutectic of pentaerythritol esters at about −50° C.

It is therefore desirable to provide new and improved solid magnet wire winding lubricants which are chemically inert in the new chlorine free refrigerants and the new ester or ether based compressor lubricants, are soluble in both, yet can be applied as magnet wire coatings by conventional techniques, and will allow winding insertion with ease and minimal damage to the magnet wire insulation.

It is also highly desirable to provide new and improved solid magnet wire winding lubricants which possess good winding and insertion properties and minimize broken or stressed wires upon insertion.

Finally, it is highly desirable to provide new and improved solid magnet wire winding lubricants which have all of the above desired features.

SUMMARY OF THE INVENTION

It is therefore an object of the invention to provide new and improved solid magnet wire winding lubricants.

It is also an object of the invention to provide new and improved solid magnet wire winding lubricants which can be utilized as internal lubricants.

It is also an object of the invention to provide new and improved solid magnet wire winding lubricants which can be used as external lubricants.

It is also an object of the invention to provide new and improved solid magnet wire winding lubricants which are chemically inert in the new chlorine free refrigerants and the new ester or ether based compressor lubricants, are soluble in both, yet can be applied as magnet wire coatings by conventional techniques, and will allow winding insertion with ease and minimal damage to the magnet wire insulation.

It is also an object of the invention to provide new and improved solid magnet wire winding lubricants which possess good winding and insertion properties and minimize broken or-stressed wires upon insertion.

Finally, it is an object of the invention to provide new and improved solid magnet wire winding lubricants which have all of the above desired features.

In the broader aspects of the invention, there is provided a magnet wire insulation material having combined therewith a magnet wire winding lubricant having the formula of $$CH_3-(CH_2)_n-\underset{\underset{O}{\|}}{C}-O-(CH_2-\underset{\underset{R}{|}}{CH}-O\rfloor_m R^1$$

where n is from about 0 to about 26, m is from about 1 to about 35 and R is a hydrogen atom or any alkyl or acyl radical or a

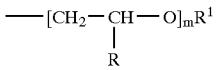

radical, and $R^1$ is a hydrogen atom or an alkyl or an acyl radical and a magnet wire having superimposed on a base insulation material a coating of a lubricant having the formula of

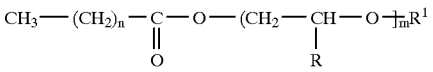

where n is from about 0 to about 26, m is from about 0 to about 35 and R is a hydrogen atom or any alkyl or acyl radical or a

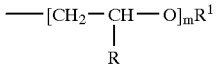

radical, and $R^1$ is a hydrogen atom or an alkyl or an acyl radical.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
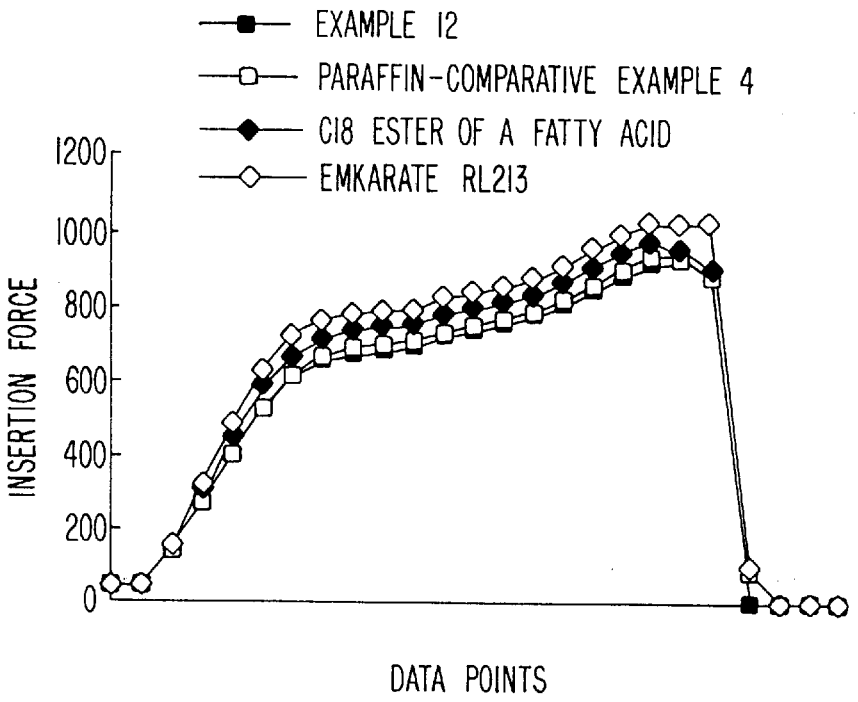
FIG. 1 is a plot of insertion force necessary to insert a preformed coil in the slots of an auxiliary coil support at the same data points corresponding to increments of insertion for Example 12 and four prior art lubricants.

The improved lubricants of the invention are successful solid magnet wire winding lubricants in all three phases of magnet wire use. The first phase is the manufacture of magnet wire, the second phase is the winding of coils of magnet wire and the insertion of coils into coil supports in the manufacture of a product, and the third phase is the long-term use in the product, such as a motor, compressor, or the like.

The solid wire winding lubricants of the invention are capable of being put on magnet wire as the magnet wire is being manufactured. One method of placing the solid wire winding lubricant on wire is to superimpose a coat of a solid winding wire lubricant on a magnet wire as a topcoat over a base insulation material prior to spooling and shipping of the magnet wire. This technique requires the solid wire winding lubricant to be applied to the magnet wire by conventional magnet wire techniques which include (1) applying the solid magnet wire winding lubricant externally from a solution thereof, wiping the excess off from the magnet wire and drying the same, (2) applying flowable lubricant externally at temperatures above their melting point, or (3) applying the lubricant as an internal lubricant combined with the topcoat insulation material by either solution or solventless conventional magnet wire application techniques. Once applied by any of these techniques, the solid magnet wire winding lubricants of the invention are durable enough to withstand conventional magnet wire handling procedures including spooling and dereeling. In fact, the lubricated magnet wire of the invention has all of the magnet wire insulation properties of the ANSI/NEMA magnet wire standards, MW1000 1993, such as flexibility, continuity, durability as measured by scrape tests, and dimensional stability. Thus, the lubricants of the invention are solid at all temperatures encountered during winding, spooling, dereeling process. These temperatures are referred to herein as "winding temperatures".

The lubricated magnet wire of the invention can be wound into coils. Conventional winding machines repetitively wind turns and insert the turns into cores or coil supports under pressure in which the magnet wire contacts other turns of magnet wire and the coil supports or slots in an abrasive manner. In the past, a magnet wire's "windability" and "insertability" have been measured by a measure of the coefficient of friction between repetitive turns of magnet wire. See NEMA Standards Publication No. MW750-1984. While "windability" and "insertability" can also be measured by actual "winding" and "insertability" tests to determine the ease of "winding" or "insertion" in specific applications, the magnet wire industry has traditionally used measurements of coefficient of friction to predict "windability" and "insertability." A surprising result of the inventions disclosed herein is that measurements of coefficient of friction do not predict the "windability" and "insertability" of the solid magnet wire winding lubricants of the invention.

Third, the solid magnet wire lubricants, once placed on the magnet wire and wound in the coils in a motor, generator, compressor, or the like, are compatible with most known uses. Both motor and generator use involve use in environments in which the temperatures cycle from about −50° C. to about 150° C. during use. During this use, there also may be movement between the respective wire turns whereby abrasion is exhibited between turns.

A more harsh usage is with motorized pumps in which the fluid being pumped passes through the motor and is in contact with the magnet wire turns to effect cooling.

Another harsh usage known is in hermetic systems in which the windings of a compressor are not only in contact with the refrigerant, but are in contact with compressor lubricants.

In the past, the refrigerants, whether FREON 12, 22 or other refrigerants, were chlorine containing and compressors utilizing these refrigerants were lubricated by mineral oil based lubricants. Nearly all of the solid magnet wire winding lubricants were paraffin, hydrogenated triglyceride and fatty ester based. These solid magnet wire winding lubricants, during use, were dissolved by the compressor lubricant or refrigerant (in time), and thus, posed no problems in the operation of the compressor during use. To eliminate problems within hermetic systems, this solubility must be maintained at from about −50° C. to about 150° C.

With chlorine containing refrigerants being not favored by environmentalists, new refrigerants not containing chlorine have been proposed. These new refrigerants called herein "non-chlorine refrigerants" or "compatible refrigerants" have caused hermetic systems to be redesigned to utilize new compressor lubricants. These new compressor lubricants are ester and ether based lubricants rather than mineral oil based lubricants and are referred to herein as ether/ester compressor lubricants.

The solid magnet wire winding lubricants of the invention, however, are soluble in these newly proposed refrigerants and ether-ester based compressor oils, and thus, do not precipitate out of solution at the lower operating temperatures.

The new and improved all purpose solid magnet wire winding lubricant of the invention, thus, is chemically inert, is compatible with the new non-chlorine containing refrigerants and ester and ether based compressor lubricants, and is soluble therein at temperatures as low as about −50° C., and is capable of interchangeably being applied to all commercially available magnet wire by conventional application techniques as either internal and external lubricants.

The improved solid magnet wire winding lubricants of the invention are esters of palmitic and stearic acid having the formula of

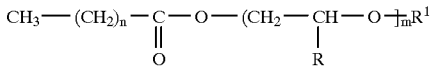

where n is from about 0 to about 26, m is from about 0 to about 35 and R is a hydrogen atom or any alkyl or acyl radical or a

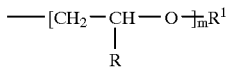

radical, and $R^1$ is a hydrogen atom or an alkyl or an acyl radical. Lubricants having an m of a value of greater than 35 appear to be relatively insoluble in the new ester and ether based compressor lubricants.

Each of these lubricants are chemically inert having minimal reactive end groups. Thus, each of these lubricants do not chemically react with conventional magnet wire insulation materials or either refrigerants or compressor lubes heretofore proposed or now proposed or most pumpable fluids. Each of these solid magnet wire winding lubricants are highly soluble in the new refrigerants, such as Du Pont's FREON R134a, and in new glycerin, pentaerythritol and polyglycol ester and ether lubricants at temperatures from about −50° C. to about 150° C.

Figure 2:
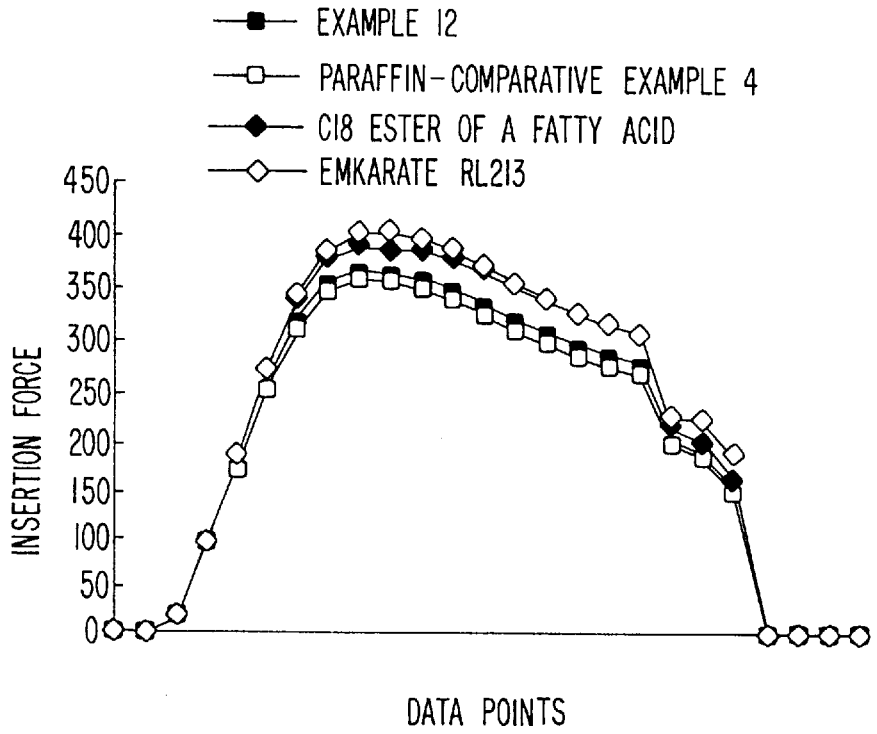
FIG. 2 is a plot of insertion force necessary to insert a preformed coil in the slots of a main coil support at the same data points corresponding to increments of insertion for Example 12 and four prior art lubricants.

Each of these improved solid magnet wire winding lubricants display improved "windability" and "insertability" as shown in FIGS. 1 and 2. These figures show insertion force plotted against various time frames of the procedure when inserting windings into auxiliary and main electric motor windings. The improved solid magnet wire winding lubricants are shown in comparison to the standard of the industry, DRI-LUBE, a paraffin based solid magnet wire winding lubricant, EMKARATE compressor oil, and a C18 ester of a fatty acid in accordance with U.S. Pat. Nos. 4,385,437 and 4,385,436.

Each of the lubricants of the invention also can be utilized interchangeably as either an internal lubricant or an external lubricant as a superimposed coating over a base insulation material. The base insulation material may be, in a specific embodiment, a concentric, continuous, flexible coat of any known magnet wire insulation material. In specific embodiments, all external lubricant coating may range from about 50 to about 150 mg per square meter. The base coat and any topcoat and lubricant and the conductor, together, have all of the properties of magnet wire as defined by the ANSI/NEMA standard MW1000 1993.

The following examples are presented herein to more fully illustrate the present invention. While specific materials are described in these examples, it should be understood that each of the above generically identified materials can be used in accordance with the invention disclosed herein to produce a product of the invention. Even within the prescribed limitation of materials listed above, a variety of products are possible; it being well within the skill of persons skilled in the art to formulate the lubricants of the invention in accordance therewith.

COMPARATIVE EXAMPLE 1

4,000 grams of a 65% solids THEIC polyester magnet wire enamel were diluted with commercial cresylic acid and phenol with a minor portion of an aromatic hydrocarbon diluent resulting in a wire enamel comprising approximately 50% weight solids and 50% weight solvent, the solvent having a cresylic acid/diluent ratio of 65 to 35.

The resultant enamel was then applied to a bare copper conductor having no insulation thereon employing dies and a conventional wire coating tower at 38 feet per minute, having temperatures of 560° F., 700° F., and 800° F., respectively. Five coats of polyester were applied in this manner.

A NYLON 6,6 magnet wire enamel was prepared as described in EXAMPLE 5 without any internal lubricant additives. This was then applied over the above polyester basecoat in two passes such that the product had a topcoat/basecoat ratio of 20/80 using the same conditions as described in EXAMPLE 5.

The resulting magnet wire was spooled and otherwise handled by conventional magnet wire techniques. The properties of the resultant magnet wire are shown in Table 2.

COMPARATIVE EXAMPLE 2

A lubricant solution was prepared by dissolving 2 grams of AMOCO ESKAR R-35 paraffin in 98 grams of heptane.

This lubricant solution was then applied to the wire prepared in COMPARATIVE EXAMPLE 1 by passing the wire over felt pads saturated with the above lubricant solution. The resulting wire was then spooled and otherwise handled by conventional magnet wire techniques.

Properties of this externally lubricated wire are shown in TABLE 2.

COMPARATIVE EXAMPLE 3

4,000 grams of a 65% solids THEIC polyester magnet wire enamel were diluted with commercial cresylic acid and phenol with a minor portion of an aromatic hydrocarbon diluent resulting in a wire enamel comprising approximately 50% weight solids and 50% weight solvent, the solvent having a cresylic acid/diluent ratio of 65 to 35.

The resultant enamel was then applied to a bare copper conductor having no insulation thereon employing dies and a conventional wire coating tower at 36 feet per minute, having temperatures of 560° F., 700° F., and 800° F., respectively. Five coats of polyester were applied in this manner.

A commercial polyamide-imide resin having 28% solids was then applied over this polyester wire such that the product had a topcoat/basecoat ratio of 20/80.

The resulting magnet wire was spooled and otherwise handled by conventional magnet wire techniques.

The properties of the resultant magnet wire are shown in Table 2.

COMPARATIVE EXAMPLE 4

A lubricant solution was prepared by dissolving 2 grams of AMOCO ESKAR R-35 paraffin in 98 grams of heptane.

This lubricant solution was then applied to the wire prepared in COMPARATIVE EXAMPLE 3 by passing the wire over felt pads saturated with the above lubricant solution. The resulting wire was then spooled and otherwise handled by conventional magnet wire techniques.

Properties of this externally lubricated wire are shown in TABLE 2.

TABLE 1

Properties Of Polymers Of Examples 1–6 Applied To An 18 AWG Bare Copper Conductor

| Example | 1 | 2 | 3 | 4 | 5 | 6 |
|---|---|---|---|---|---|---|
| Speed - fpm | 38 | 38 | 34 | 38 | 38 | 34 |
| Surface rating | 1.1 smooth | 1.2 | 1.3 ripple | 1.1 | 1.1 | 1.2 |
| Overall Diameter - in. | .0432–.0433 | .0433 | .0432–.0433 | .0430–.0432 | .0431–.0432 | .0430 |
| Bare Diameter - in. | .0401–.0402 | .0401–.0402 | .0401–.0402 | .0401–.0402 | .0401–.0402 | .0401–.0402 |
| Insulation Build - mils | 3.1 | 3.1–3.2 | 3.1 | 2.9–3.0 | 3.0 | 2.8–2.9 |
| Elongation - % | 38 | 37 | 39 | 37 | 37 | 38 |
| Mandrel Flex. | BP 1X OK | 35% 1X OK | 30% 1X OK | BP 1X OK | BP 1X OK | 30% 1X OK |
| Snap | OK | OK | OK | OK | OK | OK |
| Snap Flex | 1X OK | 1X OK | 2X OK | 1X OK | 1X OK | 2X OK |
| Heat Shock: ½ hr. | | | | | | |
| 20% 3X - 220° C. | | PASS | PASS | PASS | PASS | PASS |
| 20% 3X - 175° C. | PASS | | | | | |
| Tecbrand Burnout OFM | 1.2 | 5.5 | 7.0 | 5.8 | 4.5 | 9.1 |
| NEMA Cut-thru ° C. | 232 | 392 | 378 | 384 | 288 | 386 |
| Dielectric Breakdown - V | 7,500 | 11,800 | 12,600 | 12,080 | 11,850 | 13,400 |
| Df 240° C. 1000 Hz | | 0.08 | 0.04 | 0.09 | 0.12 | 0.04 |
| Lubricant Type | Internal | Internal | Internal | Internal | Int. + Int. | Internal |
| Lubricant Amount | 1% | 2.2% | 5% | 0.1% | 0.5% + 0.1% | 1% |
| C of F mean–max. | 0.12–0.15 | 0.23–0.26 | 0.21–0.27 | 0.19–0.25 | 0.11–0.14 | 0.22–0.26 |

Properties Of Polymers Of Examples 7–12 Applied To An 18 AWG Bare Copper Conductor

| Example | 7 | 8 | 9 | 10 | 11 | 12 |
|---|---|---|---|---|---|---|
| Speed - fpm | 28 | 36 | 38 | 34 | 38 | 36 |
| Surface rating | 1.2 | 1.1 | 1.2 | 1.2 | 1.1 | 1.1 |
| Overall Diameter - in. | .0431–.0432 | .0432 | .0431–.0432 | .0432–.0430 | .0433–.0430 | .0431–.0432 |
| Bare Diameter - in. | .0401–.0402 | .0401–.0402 | .0401–.0402 | .0401–.0402 | .0401–.0402 | .0401–.0402 |
| Insulation Build - mils | 3.0 | 3.1 | 3.0 | 2.8–3.1 | 2.8–3.2 | 2.8–3.0 |
| Elongation - % | 36 | 36 | 38 | 36 | 36 | 38 |
| Mandrel Flex. | 20% 1X OK | 35% 1X OK | 35% 1X OK | 30% 1X OK | BP 1X OK | BP 1X OK |
| Snap | OK | OK | OK | OK | OK | OK |
| Snap Flex | 2X OK | 35% 1X OK | 35% 1X OK | 2X OK | BP 1X OK | BP 1X OK |
| Heat Shock ½ hr. | | | | | | |
| 20% 3X - 220° C. | PASS | PASS | PASS | PASS | | PASS |
| 20% 3X - 175° C. | | | | | PASS | |
| Tecbrand Burnout OFM | 8.7 | 6.5 | 5.4 | 6.7 | 4.4 | 6.4 |
| NEMA Cut-thru - ° C. | 401 | 352 | 402 | 381 | 279 | 349 |
| Dielectric Breakdown - V | 11,500 | 11,800 | 12,600 | 12,680 | 9,800 | 13,400 |
| DF 240° C. 1000 Hz | .06 | .08 | .09 | .04 | .13 | .08 |
| Lubricant Type | Internal | Int. + Int. | External | External | Int. + Ext. | External |
| Lubricant Amount | 1% | 0.1% + 1.3% | 80 mg/sq. m. | 110 mg/sq. m. | 1% + 92 mg./sq. m | 138 mg./sq. m. |
| C of F mean–max. | 0.22–0.26 | 0.22–0.27 | 0.06–0.12 | 0.06–0.14 | 0.04–0.10 | 0.05–0.14 |

Properties Of Polymers Of Examples 13–16 Applied To An 18 AWG Bare Copper Conductor

| Example | 13 | 14 | 15 | 16 |
|---|---|---|---|---|
| Speed - fpm | 34 | 38 | 34 | 38 |
| Surface rating | 1.2 | 1.1 | 1.1 | 1.1 |
| Overall Diameter - in. | .0432–.0433 | .0430–.0432 | .0432 | .0431–.0432 |
| Bare Diameter - in. | .0401–.0402 | .0402–.0403 | .0402–.0403 | .0401–.0402 |
| Insulation Build - mils | 3.1 | 2.8–2.9 | 2.9–3.0 | 3.0 |
| Elongation - % | 39 | 39 | 38 | 39 |
| Mandrel Flex. | 30% 1X OK | BP 1X OK | 35% 1X OK | BP 1X OK |
| Snap | OK | OK | OK | OK |
| Snap Flex | 2X OK | 1X OK | 2X OK | 1X OK |
| Heat Shock ½ hr. | | | | |
| 20% 3X - 220° C. | Pass | Pass | Pass | |
| 20% 3X - 175° C. | | | | Pass |
| Tecbrand Burnout OFM | 7.1 | 5.7 | 6.9 | 1.7 |
| NEMA Cut-thru - ° C. | 384 | 401 | 381 | 241 |
| Dielectric Breakdown - V | 14,230 | 14,020 | 13,750 | 8,810 |
| DF 240° C. 1000 Hz | .035 | 0.09 | 0.041 | |
| Lubricant Type | Internal | Internal | Internal & External | External |
| Lubricant Amount | 0.7% | 2.7% | 5% + 115 mg/m$^2$ | 94 mg/m$^2$ |
| C of F mean–max. | 0.21–0.24 | 0.19–0.24 | .04–0.13 | 0.03–0.10 |

TABLE 2

Comparitive Properties of Standard Products Applied To An 18 AWG Bare Copper Conductor

| Comparitive Example | 1 | 2 | 3 | 4 |
|---|---|---|---|---|
| Compare to Example: | 5 | 11 | 8 | 12 |
| Speed - fpm | 38 | 38 | 36 | 36 |
| Surface rating | 1.1 | 1.1 | 1.2 | 1.2 |
| Overall Diameter - in. | .0434–.0435 | .0432 | .0431–.0432 | .0432–.0430 |
| Bare Diameter - in. | .0401–.0402 | .0401–.0402 | .0401–.0402 | .0401–.0402 |
| Insulation Build - mils | 3.3 | 3.1 | 3.0 | 2.8–3.1 |
| Elongation - % | 36 | 36 | 38 | 36 |
| Mandrel Flex | BP%1X OK | BP%1X OK | 35%1X OK | 35%1X OK |
| Snap | OK | OK | OK | OK |
| Snap Flex | BP%1X OK | 35%1X OK | 35%1X OK | 35%1X OK |
| Heat Shock 20% 3X – 220° C. | | | PASS | PASS |
| 20% 3X – 175° C. | PASS | PASS | | |
| Techrand Burnout OFM | 4.9 | 4.8 | 6.5 | 6.7 |
| NEMA Cut-thru - °C. | 279 | 282 | 376 | 381 |
| Dielectric Breakdown - V | 11,500 | 11,800 | 12,600 | 12,680 |
| Df 240° C. 1000 Hz | .16 | .15 | .14 | .14 |
| Lubricant Type | none | External | none | External |
| Lubricant Amount | 0 | 128 mg./sq.m. | 0 | 110 mg/sq.m. |
| C of F mean-max. | 0.12–0.16 | 0.04–0.09 | 0.24–0.27 | 0.041–0.080 |

EXAMPLE 1

1,000 grams of NYLON 66 and 10 grams of a lubricant having the formula

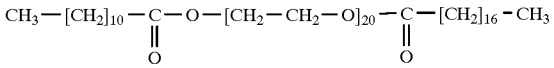

as an internal lubricant were dissolved in 4,000 grams of commercial cresylic acid. The mass was carefully heated to promote dissolving of the NYLON and the lubricant within the cresylic acid. The resulting solution was diluted with commercial cresylic acid and a minor portion of an aromatic hydrocarbon diluent resulting in an internally lubricated wire enamel comprising approximately 16% weight solids, the solvent having a cresylic acid/diluent ratio of 80 to 20.

The resultant enamel was then applied to a bare copper conductor having no insulation thereon employing dies and a conventional wire coating tower at 38 feet per minute, having temperatures of 560° F., 700° F., and 800° F., respectively. Six coats were applied in this manner. The resulting internally lubricated magnet wire was spooled and otherwise handled by conventional magnet wire techniques. The properties of the resultant magnet wire is shown in Table 1.

EXAMPLE 2

2,000 grams of a commercial 45% solids THEIC polyester magnet wire insulating material and 20 grams of a lubricant having the formula

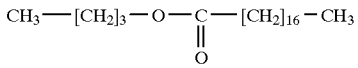

as an internal lubricant were carefully heated to promote dissolving of the lubricant within the resin solution. The resulting solution was diluted with commercial cresylic acid and a minor portion of an aromatic hydrocarbon diluent resulting in an internally lubricated wire enamel comprising approximately 35% weight solids, the solvent having a cresylic acid/diluent ratio of 70 to 30.

The resultant enamel was then applied to a bare copper conductor having no insulation thereon employing dies and a conventional wire coating tower at 38 feet per minute, having temperatures of 560° F., 700° F., and 800° F., respectively. Seven coats were applied in this manner. The resulting internally lubricated magnet wire was spooled and otherwise handled by conventional magnet wire techniques. The properties of the resultant magnet wire is shown in Table 1.

EXAMPLE 3

4,000 grams of a commercial 35% solids polyester-imide magnet wire insulation material and 70 grams of a lubricant having the formula

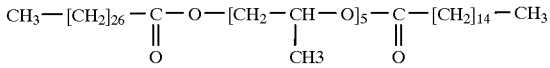

were carefully heated to promote dissolving of the lubricant within the resin solution. The resulting solution was diluted with commercial cresylic acid and a minor portion of an aromatic hydrocarbon diluent resulting in an internally lubricated wire enamel comprising approximately 28% weight solids and 72% weight solvent, the solvent having a cresylic acid/diluent ratio of 67 to 33.

The resultant enamel was then applied to a bare copper conductor having no insulation thereon employing dies and a conventional wire coating tower at 34 feet per minute, having temperatures of 560° F., 700° F., and 800° F., respectively. Seven coats were applied in this manner. The resulting internally lubricated magnet wire was spooled and otherwise handled by conventional magnet wire techniques. The properties of the resultant magnet wire are shown in Table 1.

EXAMPLE 4

4,000 grams of a 65% solids THEIC polyester magnet wire enamel and 2.6 grams of a lubricant having the formula $$CH_3-CH_2-CH_2-CH_2-\underset{\underset{O}{\|}}{C}-O-[CH_2-CH_2-O]_{30}-\underset{\underset{O}{\|}}{C}-[CH_2]_{16}-CH_3$$

as an internal lubricant was carefully heated to promote dissolving of the lubricant within the solution. The resulting solution was diluted with commercial cresylic acid and phenol with a minor portion of an aromatic hydrocarbon diluent resulting in an internally lubricated wire enamel comprising approximately 50% weight solids and 50% weight solvent, the solvent having a cresylic acid/diluent ratio of 65 to 35.

The resultant enamel was then applied to a bare copper conductor having no insulation thereon employing dies and a conventional wire coating tower at 38 feet per minute, having temperatures of 560° F., 700° F., and 800° F., respectively. Seven coats were applied in this manner. The resulting internally lubricated magnet wire was spooled and otherwise handled by conventional magnet wire techniques. The properties of the resultant magnet wire is shown in Table 1.

EXAMPLE 5

1,000 grams of NYLON 66 and 5 grams of a lubricant having the formula $$CH_3-[CH_2]_4-\underset{\underset{O}{\|}}{C}-O-[CH_2-CH_2-O]_8-\underset{\underset{O}{\|}}{C}-[CH_2]_{12}-CH_3$$

as an internal lubricant were dissolved in 4,000 grams of commercial cresylic acid. The mass was carefully heated to promote dissolving of the NYLON and the lubricant within the cresylic acid. The resulting solution was diluted with commercial cresylic acid and a minor portion of an aromatic hydrocarbon diluent resulting in an internally lubricated wire enamel comprising approximately 16% weight solids, the solvent having a cresylic acid/diluent ratio of 80 to 20.

This internally lubricated composition was applied to a copper conductor in two passes over 5 coats of the polyester from EXAMPLE 4 employing dies and a conventional wire coating tower at 38 feet per minute, having temperatures of 560° F., 700° F., and 800° F., respectively. The resulting wire contained a topcoat to basecoat ratio of 20 to 80. The resulting internally lubricated magnet wire was spooled and otherwise handled by conventional magnet wire techniques. The properties of the resultant magnet wire are shown in Table 1.

EXAMPLE 6

To 4,000 grams of a commercial 28% solids polyesterimide magnet wire enamel were added 11.2 grams of a lubricant having the formula $$CH_3-[CH_2]_{16}-\underset{\underset{O}{\|}}{C}-O-[CH_2-CH-O]-\underset{\underset{O}{\|}}{C}-[CH_2]_{16}-CH_3$$

-continued $$[CH_2-CH_2-O]_3-\underset{\underset{O}{\|}}{C}-[CH_2]_{16}-CH_3$$

The mass was carefully heated to promote dissolving of the lubricant. The resulting solution resulted in an internally lubricated wire enamel comprising approximately 28% weight solids, the solvent having a solvent/diluent ratio of 65 to 35.

The resultant enamel was then applied to a bare copper conductor having no insulation thereon employing dies and a conventional wire coating tower at 28 feet per minute, having temperatures of 560° F., 700° F., and 800° F., respectively. Nine coats were applied in this manner. The resulting internally lubricated magnet wire was spooled and otherwise handled by conventional magnet wire techniques. The properties of the resultant magnet wire is shown in Table 1.

EXAMPLE 7

To 4,000 grams of a commercial 28% solids polyamideimide magnet wire enamel were added 11.2 grams of a lubricant having the formula $$CH_3-[CH_2]_{10}-\underset{\underset{O}{\|}}{C}-O-CH_2-CH-O-\underset{\underset{O}{\|}}{C}-[CH_2]_{14}-CH_3$$
$$CH_2-CH_2-O-\underset{\underset{O}{\|}}{C}-[CH_2]_{16}-CH_3$$

The mass was carefully heated to promote dissolving of the lubricant. The resulting solution resulted in an internally lubricated wire enamel comprising approximately 28% weight solids, the solvent having a solvent/diluent ratio of 65 to 35.

The resultant enamel was then applied to a bare copper conductor having no insulation thereon employing dies and a conventional wire coating tower at 28 feet per minute, having temperatures of 560° F., 700° F., and 800° F., respectively. Nine coats were applied in this manner. The resulting internally lubricated magnet wire was spooled and otherwise handled by conventional magnet wire techniques. The properties of the resultant magnet wire is shown in Table 1.

EXAMPLE 8

To 4,000 grams of a commercial 28% solids polyamideimide magnet wire enamel were added 5 grams each of the following lubricants having the formulas:

(1)

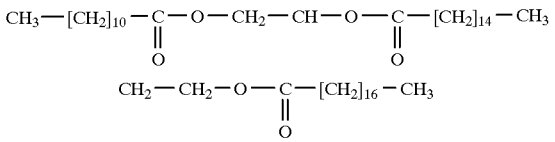

(2)

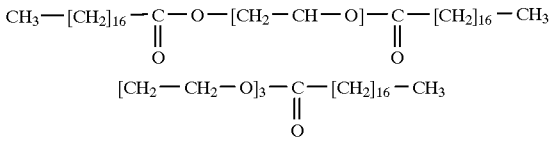

(3)

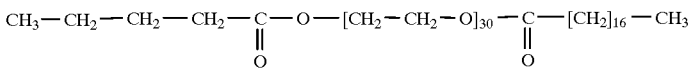

The mass was carefully heated to promote dissolving of the lubricant. The resulting solution resulted in an internally lubricated wire enamel comprising approximately 28% weight solids, the solvent having a solvent/diluent ratio of 65 to 35.

This internally lubricated composition was applied in two passes to a copper conductor coated with 5 coats of the internally lubricated polyester from EXAMPLE 4 employing dies and a conventional wire coating tower at 36 feet per minute, having a temperature of 560° F., 700° F., and 800° F., respectively.

The wire contained a topcoat to basecoat ratio of 20 to 80. The resulting internally lubricated magnet wire was spooled and otherwise handled by conventional magnet wire techniques. The properties of the resultant magnet wire is shown in Table 1.

EXAMPLE 9

The 45% solids THEIC polyester magnet wire insulating material (without lubricant) from EXAMPLE 2 was diluted with commercial cresylic acid and a minor portion of an aromatic hydrocarbon diluent resulting in a magnet wire enamel comprising approximately 35% weight solids, the solvent having a cresylic acid/diluent ratio of 70 to 30.

The resultant enamel was then applied to a bare copper conductor having no insulation thereon employing dies and a conventional wire coating tower at 38 feet per minute, having temperatures of 560° F., 700° F., and 800° F., respectively. Seven coats were applied in this manner.

Two grams of a lubricant having the formula

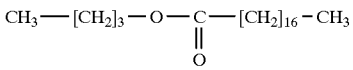

were dissolved in 98 grams of commercial ethanol resulting in a lubricant solution comprising approximately 2% weight solids.

The resultant magnet wire winding lubricant solution was then applied to the above insulated copper conductor employing saturated felt wipes. The resulting externally lubricated magnet wire was spooled and otherwise handled by conventional magnet techniques.

The properties of the resultant magnet wire are shown in Table 1.

EXAMPLE 10

The polyester-imide wire enamel used in EXAMPLE 3, was diluted with commercial cresylic acid and a minor portion of an aromatic hydrocarbon diluent resulting in a magnet wire enamel comprising approximately 28% weight solids, the solvent having a cresylic acid/diluent ratio of 67 to 33.

The resultant enamel was then applied to a bare copper conductor having no insulation thereon employing dies and a conventional wire coating tower at 34 feet per minute, having temperatures of 560° F., 700° F., and 800° F., respectively. Seven coats were applied in this manner.

Two grams of a lubricant having the formula:

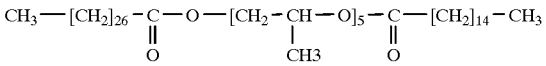

were dissolved in 98 grams of commercial ethanol resulting in a lubricant solution comprising approximately 2% weight solids.

The resultant magnet wire winding lubricant solution was then applied to the above insulated copper conductor employing saturated felt wipes. The resulting externally lubricated magnet wire was spooled and otherwise handled by conventional magnet wire techniques.

The properties of the resultant magnet wire are shown in Table 1.

EXAMPLE 11

The 45% solids THEIC polyester wire enamel from EXAMPLE 2 were diluted with commercial cresylic acid and a minor portion of an aromatic hydrocarbon diluent resulting in a magnet wire enamel comprising approximately 35% weight solids, the solvent having a cresylic acid/diluent ratio of 70 to 30.

The resultant enamel was then applied to a bare copper conductor having no insulation thereon employing dies and a conventional wire coating tower at 38 feet per minute, having temperatures of 560° F., 700° F., and 800° F., respectively. Five coats of polyester were applied in this manner.

To this wire were then applied two coats of the internally lubricated NYLON solution prepared in EXAMPLE 1.

A lubricant having the formula:

A lubricant having the formula:

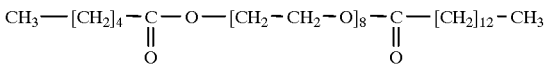

was dissolved in 98 grams of commercial ethanol resulting in a lubricant solution comprising approximately 2% weight solids.

The resultant magnet wire winding lubricant solution was then applied to the above insulated copper conductor employing saturated felt wipes. The resulting externally lubricated magnet wire was spooled and otherwise handled by conventional magnet wire techniques.

The properties of the resultant magnet wire are shown in Table 1.

EXAMPLE 12

4,000 grams of a 65% solids THEIC polyester magnet wire enamel was diluted with commercial cresylic acid and phenol with a minor portion of an aromatic hydrocarbon diluent resulting in a wire enamel comprising approximately 50% weight solids and 50% weight solvent, the solvent having a cresylic acid/diluent ratio of 65 to 35.

The resultant enamel was then applied to a bare copper conductor having no insulation thereon employing dies and a conventional wire coating tower at 38 feet per minute, having temperatures of 560° F., 700° F., and 800° F., respectively. Five coats of polyester were applied in this manner.

A commercial polyamide-imide resin having 28% solids was then applied over this polyester wire such that the product had a topcoat/basecoat ratio of 20/80.

A lubricant solution containing equal amounts of the following materials:

(1)

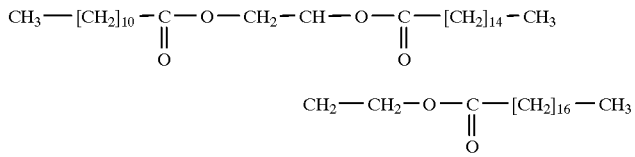

(2)

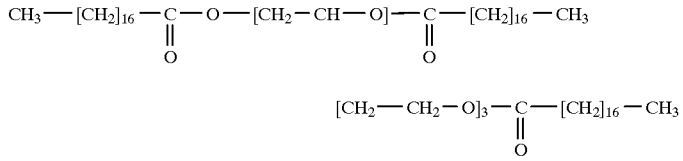

(3)

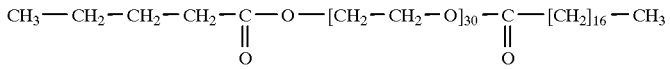

was prepared by dissolving 2 grams in 98 grams of commercial ethanol resulting in a lubricant solution comprising approximately 2% weight solids.

The resultant magnet wire winding lubricant solution was then applied to the above insulated copper conductor employing saturated felt wipes. The resulting externally lubricated magnet wire was spooled and otherwise handled by conventional magnet wire techniques.

The properties of the resultant magnet wire are shown in Table 1.

EXAMPLE 13

4,000 grams of a commercial 35% solids polyesterimide magnet wire insulation material and 10 grams of a lubricant having the formula

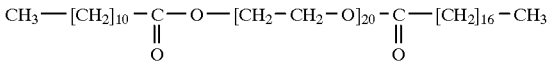

were carefully heated to promote dissolving of the lubricant within the resin solution. The resulting solution was diluted with commercial cresylic acid and a minor portion of an aromatic hydrocarbon diluent resulting in an internally lubricated wire enamel comprising approximately 28% weight solids and 72% weight solvent, the solvent having a cresylic acid/diluent ratio of 67 to 33.

The resultant enamel was then applied to a bare copper conductor having no insulation thereon employing dies and a conventional wire coating tower at 34 feet per minute, having temperatures of 560° F., 700° F., and 800° F., respectively. Seven coats were applied in this manner. The resulting internally lubricated magnet wire was spooled and otherwise handled by conventional magnet wire techniques. The properties of the resultant magnet wire is shown in Table 1.

EXAMPLE 14

4,000 grams of a commercial 65% solids THEIC polyester magnet wire insulation material and 70 grams of a lubricant having the formula

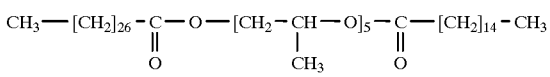

were carefully heated to promote dissolving of the lubricant within the resin solution. The resulting solution was diluted with commercial cresylic acid and a minor portion of an aromatic hydrocarbon diluent resulting in an internally lubricated wire enamel comprising approximately 28% weight solids and 72% weight solvent, the solvent having a cresylic acid/diluent ratio of 67 to 33.

The resultant enamel was then applied to a bare copper conductor having no insulation thereon employing dies and a conventional wire coating tower at 38 feet per minute, having temperatures of 560° F., 700° F., and 800° F., respectively. Seven coats were applied in this manner. The resulting internally lubricated magnet wire was spooled and otherwise handled by conventional magnet wire techniques. The properties of the resultant magnet wire is shown in Table 1.

EXAMPLE 15

The 35% solids polyester-imide magnet wire enamel from EXAMPLE 3 was diluted with commercial cresylic acid and a minor portion of an aromatic hydrocarbon diluent resulting in a magnet wire enamel comprising approximately 28% weight solids, the solvent having a cresylic acid/diluent ratio of 67 to 33.

The resultant enamel was then applied to a bare copper conductor having no insulation thereon employing dies and a conventional wire coating tower at 34 feet per minute, having temperatures of 560° F., 700° F., and 800° F., respectively. Five coats of polyester were applied in this manner.

Two grams of a lubricant having the formula:

$$CH_3-[CH_2]_3-\underset{\underset{O}{\|}}{C}-O-[CH_2-CH_2-O]_{30}-\underset{\underset{O}{\|}}{C}-[CH_2]_{16}-CH_3$$

was dissolved in 98 grams of commercial ethanol resulting in a lubricant solution comprising approximately 2% weight solids.

The resultant magnet wire winding lubricant solution was then applied to the above insulated copper conductor employing saturated felt wipes. The resulting externally lubricated magnet wire was spooled and otherwise handled by conventional magnet wire techniques.

The properties of the resultant magnet wire are shown in Table 1.

EXAMPLE 16

1,000 grams of NYLON 66 were dissolved in 4,000 grams of commercial cresylic acid. The mass was carefully heated to promote dissolving of the NYLON within the cresylic acid. The resulting solution was diluted with commercial cresylic acid and a minor portion of an aromatic hydrocarbon diluent resulting in a wire enamel comprising approximately 16% weight solids, the solvent having a cresylic acid/diluent ratio of 80 to 20.

The resultant enamel was then applied to a bare copper conductor having no insulation thereon employing dies and a conventional wire coating tower at 38 feet per minute, having temperatures of 560° F., 700° F., and 800° F., respectively. Six coats were applied in this manner.

Two grams of a lubricant having the formula:

$$CH_3-[CH_2]_{26}-\underset{\underset{O}{\|}}{C}-O-[CH_2-\underset{\underset{CH_3}{|}}{CH}-O]_5-\underset{\underset{O}{\|}}{C}-[CH_2]_{14}-CH_3$$

were dissolved in 98 grams of commercial ethanol resulting in a lubricant solution comprising approximately 2% weight solids.

The resultant magnet wire winding lubricant solution was then applied to the above insulated copper conductor employing saturated felt wipes. The resulting externally lubricated magnet wire was spooled and otherwise handled by conventional magnet wire techniques.

The properties of the resultant magnet wire are shown in Table 1.

The improved solid magnet wire winding lubricants of the invention can be utilized both as internal magnet wire lubricants and as external magnet wire lubricants with any of the known magnet wire insulation materials. These lubricants are chemically inert with regard to most conventional magnet wire insulation materials, both chlorinated refrigerants and chlorine free refrigerants, both ether/ester based and mineral oil based compressor lubricants, and most fluids which are pumped through motor pump combinations. The new and improved solid magnet wire winding lubricants of the invention can be applied to magnet wire by conventional magnet wire techniques either as an internal or external lubricant and the lubricated magnet wire can be spooled and otherwise handled as magnet wire. In fact, the lubricated magnet wire of the invention meets all of the ANSI/NEMA MW1000, 1993 standards. The improved magnet wire lubricants of the invention are soluble in the nonchlorine refrigerants and the ester and ether based compressor lubricants at temperatures from about −50° C. to about 150° C. Most importantly, the improved solid magnet wire winding lubricants of the invention facilitate the winding of coils for magnet wire as well as the preferred prior art magnet wire winding lubricants.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A magnet wire insulation material having combined therewith a magnet wire winding lubricant having the formula of $$CH_3-(CH_2)_n-\underset{\underset{O}{\|}}{C}-O(CH_2-\underset{\underset{R}{|}}{CH}-O)_mR^1$$

where n is from about 0 to about 26 and m is from about 1 to about 35 and R is a hydrogen atom or any alkyl or acyl radical or a $$-[CH_2-\underset{\underset{R}{|}}{CH}-O]_mR^1$$

radical and $R^1$ is a hydrogen atom or an alkyl or acyl radical, said magnet wire lubricant being chemically inert, said magnet wire lubricant being soluble in ether/ester compressor lubricants and their compatible refrigerants at temperatures from about −50° C. to about 150° C., said magnet wire lubricant being solid at all winding temperatures.

2. The magnet wire insulation material of claim 1 wherein the magnet wire insulation material and lubricant combination has from about 0.1% weight to about 5% weight lubricant.

3. The magnet wire insulation material of claim 1 where n is about 14, and R and $R^1$ are chosen from the group of methyl, hydrogen, ethyl, propyl, butyl and stearyl radicals and combinations of the same.

4. The magnet wire insulation material of claim 1 where n is about 16, and R and $R^1$ are chosen from the group consisting of hydrogen, methyl, ethyl, propyl, butyl, stearyl and palmityl radicals and combinations of the same.

5. The magnet wire insulation material of claim 1 where n is 16 and m is 8 and R and $R^1$ are chosen from the group of hydrogen, methyl, ethyl, propyl, butyl, stearyl and palmityl radicals and combinations of the same.

6. The magnet wire insulation material of claim 1 where n is about 16 and m is about 2 and $R^2$ is chosen from the group of hydrogen, methyl, ethyl, propyl, butyl, stearyl, palmityl and

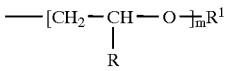

radicals and combinations of the same.

7. A magnet wire having superimposed thereon a continuous concentric flexible coating of a lubricant having the formula

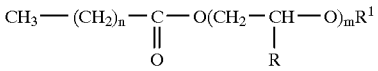

where n is from about 0 to about 26 and m is from about 0 to about 35 and R is a hydrogen atom or any alkyl or acyl radical or a

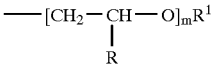

radical and $R^1$ is a hydrogen atom or an alkyl or acyl radical, said lubricant being chemically inert, said magnet wire lubricant being soluble in ether/ester compressor lubricant and their compatible refrigerants at temperatures from about −50° C. to about 150° C., said magnet wire lubricant being solid at all winding temperatures.

8. The magnet wire of claim 7 where n is about 14, m is 0 and $R^1$ is chosen from the group of methyl, hydrogen, ethyl, propyl, butyl and stearyl radicals.

9. The magnet wire of claim 7 where n is about 16, and m is about 0 and $R^1$ is chosen from the group consisting of hydrogen, methyl, ethyl, propyl, butyl, stearyl and palmityl radicals.

10. The magnet wire of claim 7 where n is about 16 and m is about 8 and R and $R^1$ are chosen from the of methyl, ethyl, propyl, butyl, stearyl and palmityl radicals and combinations of the same.

11. The magnet wire of claim 7 where n is about 16 and m is about 2 and R is chosen from the group of hydrogen, methyl, ethyl, propyl, butyl, stearyl, palmityl and

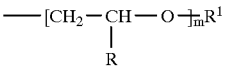

radicals and combinations of the same.

* * * * *